United States Patent [19]

Brink et al.

[11] Patent Number: 5,007,562

[45] Date of Patent: Apr. 16, 1991

[54] COLLAPSIBLE CLOTHES HANGER

[76] Inventors: Joyce Brink; James E. Brink, both of 1142 Bobolink Dr., Vista, Calif. 92083

[21] Appl. No.: 377,279

[22] Filed: Jul. 10, 1989

[51] Int. Cl.[5] ..... A47G 25/42; A47G 25/40; A47G 25/16

[52] U.S. Cl. ..... 223/89; 223/94; 223/92; 223/88; 223/85

[58] Field of Search ..... 223/88, 89, 92, 94, 223/DIG. 3, DIG. 4, 85; D6/315, 324

[56] References Cited

U.S. PATENT DOCUMENTS

| | | | |
|---|---|---|---|
| 1,278,054 | 4/1918 | Strand | 223/89 |
| 1,374,024 | 4/1921 | Morton | 223/89 |
| 1,444,525 | 2/1923 | Rosenthal . | |
| 1,458,114 | 6/1923 | Sommer . | |
| 1,970,943 | 1/1932 | Raymond | 223/64 |
| 2,108,622 | 2/1938 | Strezoff . | |
| 2,232,249 | 2/1941 | Losin . | |
| 2,544,170 | 3/1951 | Mills . | |
| 2,728,499 | 12/1955 | Mueller | 223/94 |
| 2,808,187 | 1/1957 | Bailey . | |
| 3,703,978 | 11/1972 | Sammaratino et al. . | |

FOREIGN PATENT DOCUMENTS

| | | | |
|---|---|---|---|
| 128362 | 6/1946 | Australia | 223/88 |
| 2107506 | 2/1971 | Fed. Rep. of Germany | 223/94 |
| 2616143 | 10/1977 | Fed. Rep. of Germany | 223/94 |
| 936265 | 7/1948 | France | 223/94 |
| 645776 | 11/1950 | United Kingdom | 223/89 |
| 759905 | 2/1954 | United Kingdom | 223/94 |

*Primary Examiner*—Werner H. Schroeder
*Assistant Examiner*—Bibhu Mohanty
*Attorney, Agent, or Firm*—Brown, Martin, Haller & McClain

[57] ABSTRACT

A collapsible clothes hanger comprises a central support bracket with a suspending member or hook extending in a first direction from the support bracket. A pair of hanger arms are pivotally mounted on the support bracket for movement between a first, extended position in which they extend in opposite directions from the support bracket angled away from the suspending member, and a second, collapsed position in which they extend generally parallel to one another in the same direction as the suspending member.

14 Claims, 2 Drawing Sheets

COLLAPSIBLE CLOTHES HANGER

BACKGROUND OF THE INVENTION

The present invention relates generally to clothes or garment hangers, and is particularly concerned with clothes hangers which can be collapsed when not in use.

Clothes hangers typically comprise a suspending member or hook for suspending the hangers from a suitable support bar or closet rod, and a pair of angled arms extending in opposite directions from the hook over which the shoulders of a garment can be engaged to suspend the garment from the hanger in a generally upright orientation for storage, so as to reduce the risk of creasing. Hangers also often include a transverse arm connecting the free ends of the angled arms to form a support for garments such as trousers, and may have hooks or notches for engaging loops on garments such as skirts. Such hangers are relatively wide and are therefore not convenient for carrying around in a purse, suitcase or the like. However, when traveling or when needing to change clothes while away from home, there is often a need to have one or more extra clothes hangers available for use. For example, hotels often provide insufficient hangers for their visitors use, and if visiting friends extra hangers may not be available.

For these reasons, collapsible hangers have been proposed in the past which are collapsible or foldable into a relatively compact unit for storage or transportation, and which can be opened out when needed for use. However, there are some problems with these hangers in providing sufficient support for relatively heavy clothing without inadvertent collapsing of the hanger structure.

SUMMARY OF THE INVENTION

It is an object of this invention to provide an improved collapsible clothes hanger.

According to the present invention, a collapsible clothes hanger is provided which comprises a central support bracket, a suspending member extending in a first direction from the bracket for suspending the hanger from a suitable support, and a pair of hanger arms pivotally mounted on the support bracket for movement between a first, extended position in which they extend in opposite directions from the support bracket angled away from the suspending member, and a second, collapsed position in which they extend generally parallel to one another in the same direction as the suspending member. The support bracket includes a stop or supporting structure associated with each arm in the extended position for restricting further pivotal movement of the arm away from the suspending member in that position. Preferably, the support bracket includes a releasable retainer or catch mechanism for releasably retaining the arms in both the extended and collapsed positions.

With this arrangement, the hanger is less likely to collapse inadvertently since the hanger arms can fold or pivot in only one direction away from the extended position, and that direction is opposite to the direction of load on the hanger arms when supporting clothing. Also, the arms are releasably retained in the collapsed position in the support bracket, so that they are unlikely to be inadvertently extended, for example when carried in a suitcase. The hanger will be maintained in its collapsed, compact position until needed.

Preferably, the hanger arms are pivoted to the support bracket by separate, spaced pivots on opposite side faces of the bracket, to allow the arms to be folded freely into a collapsed, folded orientation in which they overlap one another with the suspending member or hook located between the two arms. The arms may each include a transverse extension arm at their outer free end in the extended position, the extension arms extending towards one another in alignment to form a support for trousers and the like. Preferably, a slidable connecting piece or tube is slidably mounted on one of the extension arms and can slide over the aligned end of the other extension arm in the extended position to form a continuous transverse support. Hooks or indents for skirt loops or the like may be provided on the arms in the normal manner.

In a preferred embodiment of the invention, the central support bracket comprises a flat central web having channels on its opposite side faces for receiving portions of the respective hanger arms in both the extended and collapsed positions. The suspending member is swivel mounted on the central web. The hanger arms are preferably sized for a snap fit in the channels, so that they are positively retained in the channels in both the extended and collapsed positions. Preferably, the channel and pivot structure on one side face of the central web is the reverse of that on the opposite side face so that the oppositely directed hanger arms are identically mounted and retained on both faces of the support bracket.

The collapsible clothes hanger of this invention is highly compact when folded to allow a large number of the hangers to be transported in a suitcase or small carrying bag. The hanger is of simple, lightweight construction yet provides a strong support when open which resists inadvertent collapse.

BRIEF DESCRIPTION OF THE INVENTION

The present invention will be better understood from the following detailed description of a preferred embodiment, taken in conjunction with the accompanying drawings, in which like reference numerals refer to like parts, and in which.

DESCRIPTION OF THE PREFERRED EMBODIMENT

Figure 1:
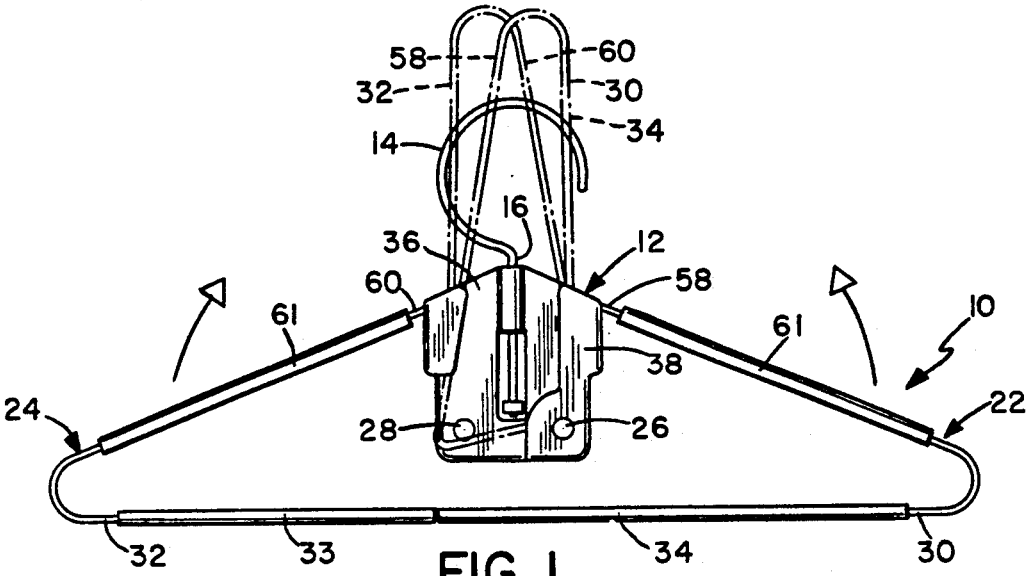
FIG. 1 is a side elevation view of the garment hanger showing the open and folded positions.

The drawings illustrate a folding or collapsible clothes hanger 10 according to a preferred embodiment of the present invention. The hanger basically comprises a central, generally flat or planar support bracket 12 with a suspending member or hook 14 projecting upwardly from the bracket for suspending the hanger from a suitable closet rod or other support. The hook 14 may be formed integrally with the bracket 12 but in the preferred embodiment illustrated it is swivel mounted on the bracket via stem 16 which extends slidably through suitable openings 18 in the bracket. A boss 20 on the free end of stem 16 retains the hook on the bracket, while the hook can be swiveled freely into the desired orientation for engagement with a support.

Figure 3:
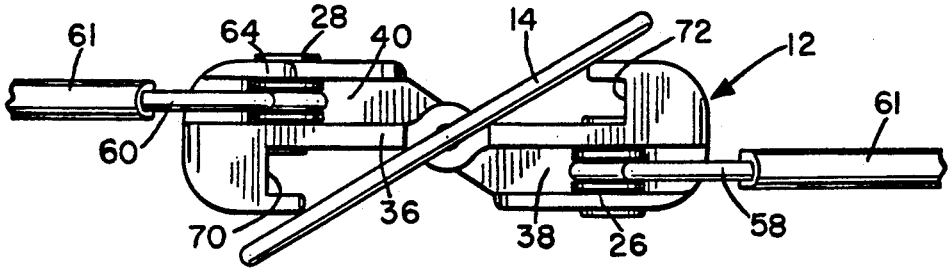
FIG. 3 is a top plan view of the central bracket unit.

A pair of hanger arms 22,24 are pivotally mounted on the support bracket 12 via spaced pivots 26,28, respectively for movement between the extended position shown in solid lines in FIG. 1, in which the arms project in opposite directions from the bracket and are angled generally downwardly away from the hook 14 to provide the correct sloping surface for engaging the shoulder regions of a garment, and the collapsed position shown in dotted outline in FIG. 1, in which the arms extend generally parallel to one another in the same direction as hook 14. The pivots 26 and 28 are mounted on opposite side faces of the bracket member so that the hanger arms are pivoted in parallel planes offset from one another as illustrated in FIG. 3. Thus, they can be freely pivoted into an overlapping, collapsed position lying one on top of the other.

Figure 2:
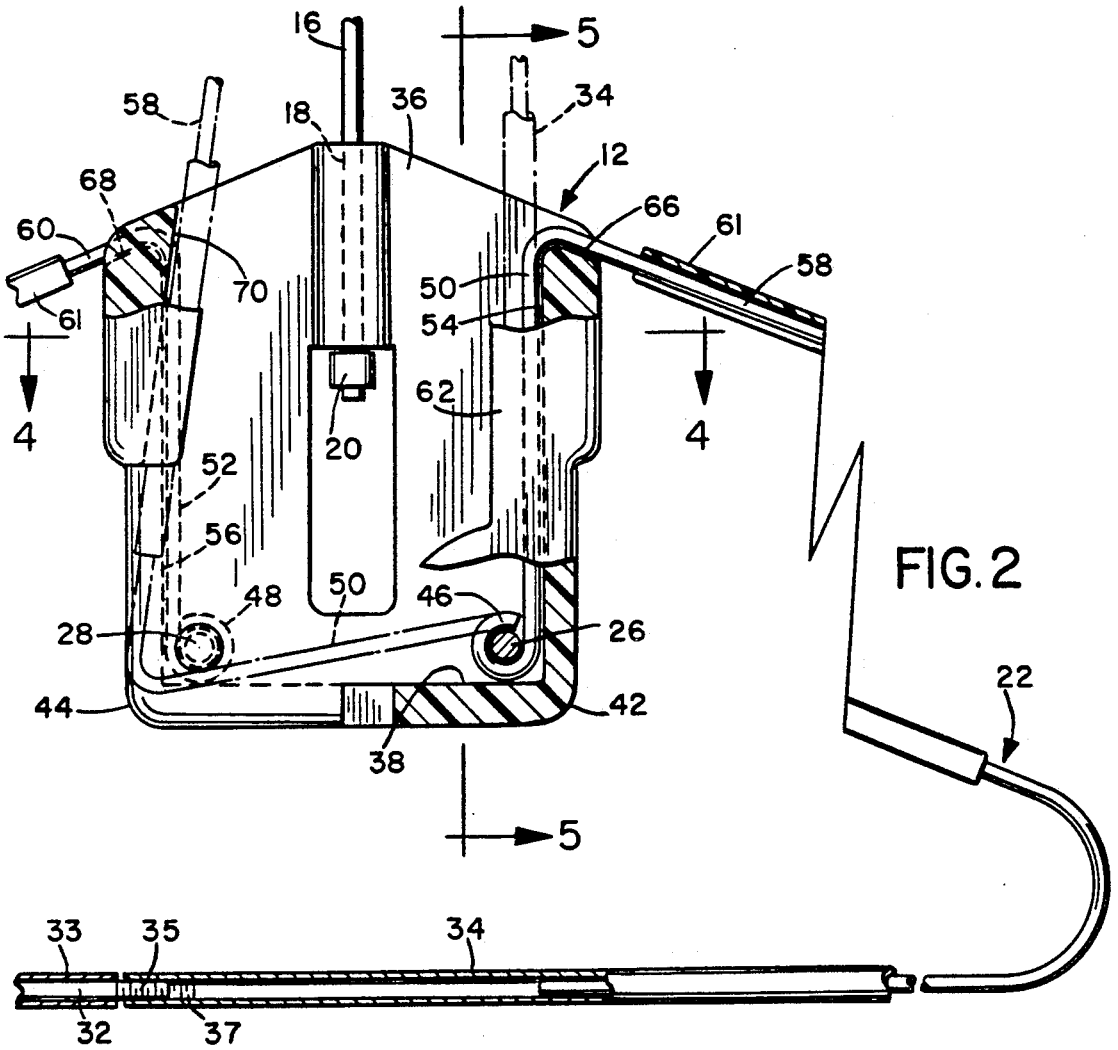
FIG. 2 is an enlarged view of the central bracket with portions cut away.
Figure 6:
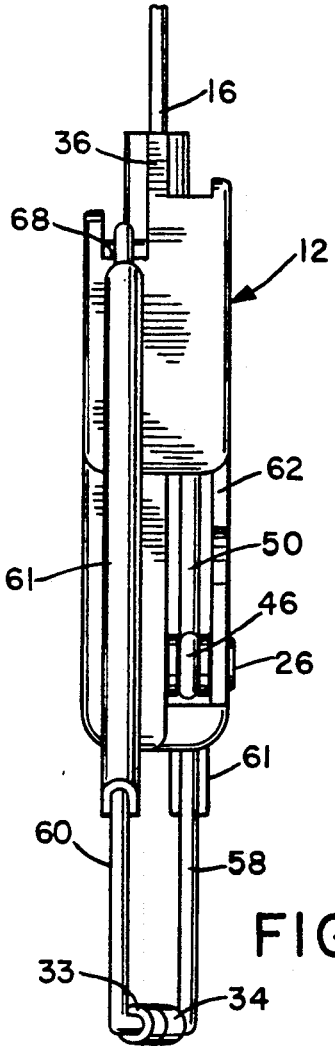
FIG. 6 is an end view of the hanger in the open position.

In the preferred embodiment illustrated, each hanger arm has an inturned end portion 30,32, the end portions 30,32 being substantially aligned with one another in the extended position to form a transverse arm or member for supporting trousers and similar garments. There will be an offset between the end portions 30 and 32 due to the offset between arms 22 and 24, as illustrated in FIG. 3. However, this slight offset may be compensated by angling end portions 30 and 32 towards one another as indicated in FIG. 6. A sleeve or tube 33,34 is slidably mounted on each of the end portions 30,32 and end portion 32 has screw threads 35 at its free end for threaded engagement with internal screw threads 37 at the free end of sleeve 34. The sleeves 33,34 are in abutting relationship at their 15 inner ends when the hanger is assembled as illustrated in FIG. 1, forming a continuous support surface for trousers or the like. Alternatively, a single sleeve may be mounted on one of the end portions for sliding over the opposing end of the other end portion 32 as indicated in FIG. 2 to form a continuous transverse supporting member. When the hanger is to be collapsed, the sleeve 34 can be unscrewed and moved back onto the end portion 30 to release end portion 32, allowing the two arms to be folded in opposite directions towards the folded position, as indicated by the arrows in FIG. 1. The end portion 32 has a screw threaded engagement with sleeve 34, so that the parts will be unlikely to slide apart inadvertently during use. The sleeve 34 preferably has some flexibility to allow for any offset between the ends of end portions 30 and 32, as generally illustrated in FIG. 6.

Figure 4:
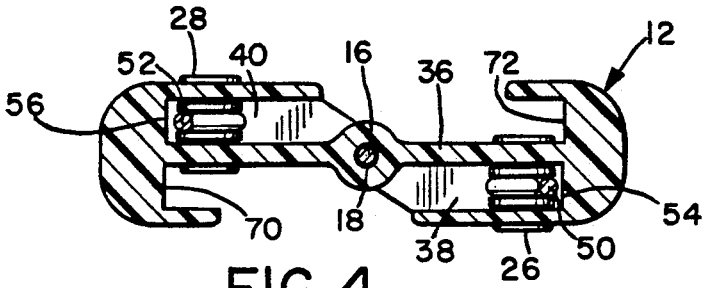
FIG. 4 is a sectional view taken on line 4—4 of FIG. 2.
Figure 5:
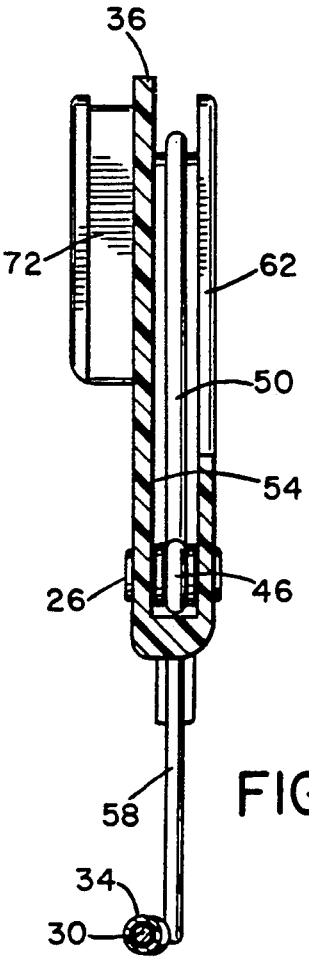
FIG. 5 is a sectional view taken on line 5—5 of FIG. 2.

The central support bracket comprises a generally flat central web 36 and the arms 22 and 24 are pivotally mounted on opposite side faces of web 36, as best illustrated in FIGS. 3 and 4. The bracket is of a suitable strong and rigid material, such as metal or stranded nylon. The two pivots 26 and 28 are spaced apart both laterally and transversely so that the respective arms can be folded together into a parallel, overlapping relationship with the width of the folded structure being substantially equal to the maximum width across one of the hanger arms from its upper end to the transverse or inturned end portion.

Channel structures 38,40 are provided on opposite faces of the web for locating portions of the respective hanger arms in both the extended and collapsed positions, both to retain the arms in those positions and to provide support for the arms. As can be seen in FIG. 3, the channel structure 38 on one face is the reverse of that on the opposite face, to allow location and retention of the oppositely directed hanger arms. In other words, the channel structure on one face is rotated 180 degrees about the center line or hook pivot axis relative to the channel structure on the opposite face. The channel structure comprises a generally L-shaped channel following the outer periphery at the opposite lower corners 42,44, respectively, of the central web. Pivots 26,28 extend through the respective corners of the channels, and eyelets 46,48 at the ends of the respective hanger arms are pivotally engaged over the respective pivots, as best illustrated in FIG. 2. Each arm 22,24 has a straight portion 50,52 which extends vertically along the longer portion 54,56 of the respective L-shaped channel in the extended position, as illustrated in FIG. 2. The arms are then bent at an acute angle to portions 50,52 to form the angled, support portions 58,60. The hanger arms may be of any suitable material such as coated wire or plastic material. Also, snap on extrusions 61 or covers of a soft plastic type may be provided on angled portions 58,60 to protect the shoulders of clothing against creasing. Although in the preferred embodiment illustrated, the hangers have a transverse support member, hangers without a transverse support may also be provided for supporting shirts, jackets, dresses, and the like. In the latter case, the hanger arms would terminate at the ends of angled portions 58 and 60, omitting the inturned end portions.

The outer walls 62,64 of each channel are spaced from the adjacent face of the central web by a distance substantially equal to the thickness of the hanger arms, so that the arms are a snap fit in the respective channels. The upper end 66,68 of each channel is shaped to follow the angle of the respective hanger arms, so that the upper ends 66,68 form support surfaces for the hanger arms, as illustrated in FIG. 2. This supports the hanger arms so that they are less likely to distort when carrying relatively heavy garments, and additionally acts as a stop restricting further pivotal movement of the arms away from hook 14, i.e. preventing the arms from collapsing downwardly under load.

The outer walls 62,64 are high enough to retain portions of the hanger arms in both the extended and collapsed positions. When the arms are extended, as illustrated in FIG. 2, the entire length of the straight portion of each hanger arm is retained in the respective channel. When the arms are rotated upwardly from the solid line position illustrated in FIG. 2, parts of the straight portions will still be retained behind walls 62,64, as can be seen in FIGS. 1 and 2. The inturned end portions 30 and 32 are then snapped into the respective channels 54 and 56, as illustrated in FIGS. 1 and 2. Preferably, an additional support channel 70,72 is provided at the upper corner of each face of the central web facing the respective channels 38,40, for retaining part of the angled portion of each arm in the collapsed position, as can be seen in FIG. 2. The arms and channels are dimensioned for snap or frictional engagement between the respective parts, so that the arms will be positively retained against inadvertent movement in both the extended and collapsed positions.

The dimensions of the hanger are substantially equivalent to those of standard clothes hangers. In one specific example, the transverse arm of the hanger was of the order of 16 to 17 inches in length, while the height of the hanger arms from transverse arm to the apex of the support bracket was of the order of 4 to 5 inches. Where the hanger arms were of ⅛ inch (0.125) diameter plastic coated wire, the channel thickness was of the order of 9/64 inches (0.140), so that the arms were a close, snap fit in the channels. The height of the channel outer walls was of the order of 10/16 inches. The dimensions of the central bracket were of the order of 3⅜ inches by 3 inches by 11/16 inches. The offset between the hanger arms (see FIG. 3) is approximately equal to the thickness of hook 14. In this particular example, this thickness was around ⅛ inch. It will be understood that these dimension are by way of example only, and other dimensions may be used in alternative embodiments.

In order to extend the hanger arms from the collapsed, compact position shown in dotted outline in FIGS. 1 and 2, the arms are urged in opposite directions away from the hook 14. The arms pivot freely on the respective pivots until the straight portion of each arm engages in the vertical portion of the respective channel, preventing further rotation of the arm. The tube or sleeve member is then slid sideways over the inturned end portion of arm 32, and the hanger is ready to use. The central support bracket helps to support the hanger arms in the extended position and also opposes collapse of the arms beyond the extended position illustrated. Thus, even relatively heavy garments can be supported relatively securely. The support bracket supports the hanger arms when open, and retains them when closed.

To fold the hanger, the sleeve member is first slid sideways onto the end portion of arm 30, releasing arm 32. The arms are then pivoted upwards towards hook 14 until they are retained in the central bracket in the collapsed position illustrated in dotted outline in FIG. 1. In this position, the arms 22,24 are retained in an overlapping parallel relationship with the hook located in the space between the overlapping arms. Thus the thickness of the collapsed assembly will be equal to the thickness of support bracket 12, the width will be equal to the width of bracket 12, and the height will be of the order of one half the length of the transverse support. As can be seen, this position is highly compact and will allow several hangers to be transported easily in a suitcase or small carrying bag. A special carrying case with several pouches each designed to carry a single collapsed hanger may be provided for easy transportation.

It can be seen that the collapsible hanger described above will be very useful when traveling or when a clothes change is needed while away from home. Sufficient hangers can be carried around in a compact form taking up little space until needed, and can be opened up quickly and easily into a strong, relatively rigid clothes supporting hanger. The central support bracket significantly adds to the strength of the hanger yet is relatively lightweight and easy to make. It may be molded integrally in one piece or may alternatively be formed from metal pieces suitably welded or riveted together.

Although a preferred embodiment of the invention has been described above by way of example only, it will be understood by those skilled in the field that modifications may be made to the disclosed embodiment without departing from the scope of the invention, which is defined by the appended claims.

We claim:

1. A collapsible clothes hanger comprising:

a central support bracket;

a suspending member extending in a first direction from the support bracket for suspending the hanger from a support;

first and second hanger arms pivotally mounted on said support bracket for movement between a first, extended position in which they extend in generally opposite directions away from said support bracket and angle downwardly relative to said suspending member, and a second, collapsed position in which they extend generally parallel to one another upwardly in said first direction from said support bracket in the same direction as said suspending member; and said central support bracket comprising a generally flat central web in the plane of said hanger, and first and second pivot means mounted on opposite side faces of said web for pivotally mounting said first and second hanger arms, respectively, on said bracket for pivotal movement in offset planes parallel to the plane of said central web.

2. The hanger as claimed in claim 1, wherein said support bracket includes stop means for restricting movement of said arms away from said suspending member beyond said extended position.

3. The hanger as claimed in claim 1, wherein said support bracket includes releasable retaining means for releasably retaining portions of said hanger arms in both said extended and collapsed positions.

4. The hanger as claimed in claim 1, wherein said suspending member comprises a hook swivel mounted on said support bracket.

5. The hanger as claimed in claim 1, wherein said bracket has oppositely directed channels on opposite side faces of said web, said pivot means being located in said respective channels, and said channels comprising means for releasably retaining portions of said hanger arms in both said extended and collapsed positions.

6. The hanger as claimed in claim 5, wherein said channels are generally L-shaped and face towards one another, and said pivot means are located at the corner of said L-shaped channels.

7. The hanger as claimed in claim 6, wherein each hanger arm has eyelet means at one end pivotally mounted on a respective one of said pivot means in said channels, and includes a straight portion extending along the longer arm of said L-shaped channel in said extended position of said arm, and located partially in the shorter arm of said L-shaped channel in said collapsed position of said arm, and an angled portion extending from said straight portion.

8. The hanger as claimed in claim 7, wherein said pivot means are spaced apart in the plane of said hanger by a distance equal to the length of the straight portion of each hanger arm.

9. The hanger as claimed in claim 7, wherein each channel has an angled upper end portion at an angle corresponding to the angle of said angled portions of said arms for supporting part of said angled portions in said extended position and for restricting pivotal movement of said arms beyond said extended position.

10. The hanger as claimed in claim 6, including an additional channel on each face of said web comprising retaining means for retaining additional portions of said hanger arms in said collapsed position.

11. The hanger as claimed in claim 1 wherein said support bracket includes support means for supporting said arms in said extending position, and retaining means for releasably retaining said arms in said collapsed position.

12. A collapsible clothes hanger, comprising:

a central support bracket;

a suspending member extending in a first direction from the support bracket for suspending the hanger from a support;

first and second hanger arms pivotally mounted on said support bracket for movement between a first, extended position in which they extend in generally opposite directions away from said support bracket and angled downwardly relative to said suspending member, and a second, collapsed position in which they extend generally parallel to one another upwardly in said first direction from said support bracket in the same direction as said suspending member;

said support bracket including releasable retaining means for releasably retaining portions of said hanger arms in both said extended and collapsed positions; and said support bracket having oppositely directed channels comprising said releasable retaining means for receiving portions of said hanger arms in both said positions, said hanger arm portions being a snap fit in said channels.

13. A collapsible clothes hanger comprising:

a central support bracket;

a suspending member extending in a first direction from the support bracket for suspending the hanger from a support;

first and second hanger arms pivotally mounted on said support bracket for movement between a first, extended position in which they extend in generally opposite directions away from said support bracket and angled downwardly relative to said suspending member, and a second, collapsed position in which they extend generally parallel to one another upwardly in said first direction from said support bracket in the same direction as said suspending member; and each hanger including an in-turned extension portion at its outer free end in the extended position, the extension portions facing towards one another to form a transverse support.

14. The hanger as claimed in claim 13, further including a slidable connecting piece slidably mounted on one of the extension portions and movable between a retracted position on said portion and an extended position in which it slides over the end of the other extension portion to connect the extension portions together.

* * * * *